US008636390B2

(12) United States Patent
Middy

(10) Patent No.: US 8,636,390 B2
(45) Date of Patent: Jan. 28, 2014

(54) LIGHT EMITTING DIODE LAMP

(75) Inventor: Olivier Middy, Rochefort sur Loire (FR)

(73) Assignee: Cemm Thome SK Spol Sro, Presov (SK)

( * ) Notice: Subject to any disclaimer, the term of this patent is extended or adjusted under 35 U.S.C. 154(b) by 358 days.

(21) Appl. No.: 12/568,418

(22) Filed: Sep. 28, 2009

(65) Prior Publication Data

US 2010/0142218 A1 Jun. 10, 2010

(30) Foreign Application Priority Data

Sep. 29, 2008 (FR) ..... 08 56526

(51) Int. Cl.
*F21S 13/02* (2006.01)

(52) U.S. Cl.
USPC ..... 362/457; 362/646; 362/652; 362/655; 362/656; 362/657; 362/658; 362/659; 362/549; 362/249.02; 362/800; 439/619; 439/699.1; 439/699.2; 439/869; 439/885; 439/877; 439/878; 439/879; 439/880; 439/882

(58) Field of Classification Search
USPC ..... 362/646, 652, 655–659, 549, 457, 362/249.02, 800; 439/619, 699.1, 699.2, 439/869, 877–882, 885
See application file for complete search history.

(56) References Cited

U.S. PATENT DOCUMENTS

| | | | | |
|---|---|---|---|---|
| 4,214,361 | A * | 7/1980 | Coldren et al. | 29/863 |
| 4,239,319 | A * | 12/1980 | Gladd et al. | 439/620.21 |
| 5,176,545 | A * | 1/1993 | Brown | 439/885 |
| 5,436,809 | A | 7/1995 | Brassier et al. | |
| 5,519,596 | A | 5/1996 | Woolverton | |
| 6,283,797 | B1 * | 9/2001 | Wu | 439/699.2 |
| 7,001,046 | B2 * | 2/2006 | Kaga et al. | 362/294 |
| 7,186,363 | B2 * | 3/2007 | Yabusaki et al. | 264/219 |
| 7,422,489 | B1 * | 9/2008 | Tseng | 439/699.2 |
| 7,731,520 | B1 * | 6/2010 | Daily et al. | 439/357 |
| 2001/0007526 | A1 * | 7/2001 | Ohkohdo et al. | 362/249 |
| 2003/0218417 | A1 | 11/2003 | Chin | |
| 2005/0227541 | A1 * | 10/2005 | Garcia et al. | 439/619 |
| 2005/0237760 | A1 | 10/2005 | Tsukamoto et al. | |
| 2007/0223241 | A1 | 9/2007 | Takahashi et al. | |
| 2007/0259576 | A1 | 11/2007 | Brandt et al. | |
| 2009/0009977 | A1 | 1/2009 | Enomoto et al. | |

FOREIGN PATENT DOCUMENTS

| | | |
|---|---|---|
| EP | 1758179 | 2/2007 |
| FR | 2876965 | 4/2006 |

OTHER PUBLICATIONS

French Search Report for FR 0856526 issued May 29, 2009.

* cited by examiner

*Primary Examiner* — Robert May
*Assistant Examiner* — Tsion Tumebo
(74) *Attorney, Agent, or Firm* — Meyertons, Hood, Kivlin, Kowert & Goetzel, P.C.; Eric B. Meyertons

(57) ABSTRACT

A light emitting diode lamp, includes a pair of contacts for the electrical connection of the light emitting diode, wherein the pair of contacts includes two crimp contacts separated electrically from one another, each crimp contact including a conducting input including a conducting crimping skirt and a clinching zone intended to receive by clinching an electrical contact of the light emitting diode.

19 Claims, 7 Drawing Sheets

LIGHT EMITTING DIODE LAMP

BACKGROUND OF THE INVENTION

1. Field of the Invention

The invention relates to so-called LED ("Light Emitting Diode") lamps. More particularly, the invention relates to such a lamp which is intended to be mounted in a motor vehicle light. It will be noted however that no departure from the scope of the invention is involved if the LED lamp is intended for the interior lighting of a motor vehicle or for the lighting of a property.

2. Description of the Relevant Art

Currently, the lights of a motor vehicle have complex and varied geometries and the integration of LED lamps or conventional bulb lamps requires the use of electrical power supply supports for the lamps which are sufficiently flexible.

LED lamps exist which comprise two electrical contacts for powering the LED. These contacts may be simple electrical stems, or lugs, which make it possible to link the LED to a power supply circuit by welding. These power supply circuits are printed circuit boards, or PCBs, but these circuits are rigid.

There also exist flexible circuits incorporating LEDs of SMC, or surface mounted component, type, but the methods of mounting these LEDs on these flexible circuits are expensive.

French Patent Application FR 2 876 965 may moreover be cited, which describes an LED support comprising two conducting tracks for joining by welding with said LEDs. However, this type of support is not sufficiently flexible to adapt to the current geometries of vehicle lights. Furthermore, this document describes a linking of the LEDs to the circuit by welding which requires the addition of further materials such as solder paste or tin.

Other LED lamps have electrical contacts which have a plane form and which are intended to be clinched to conducting tracks suitable for clinching. Clinching consists in permanently joining two metal sheets by stamping the two sheets placed between a punch and a die. Moreover, current clinched LEDs are mounted on rigid circuits.

Moreover, Canadian Patent Application CA 2 562 357 may be cited, which describes a metal circuit supporting light emitting diodes, but this support circuit is rigid and does not offer sufficient freedom of arrangement of the LEDs. Furthermore, this document describes an LED having contacts in the form of stems which are crimped to conducting wires. However, this crimping process is not suitable for other types of LED such as, for example, clinched LEDs. Furthermore, the conducting wires used do not allow sufficient dissipation of the heat of the LEDs.

A requirement therefore exists to provide an LED lamp which can address the various problems mentioned above.

SUMMARY OF THE INVENTION

One embodiment is directed to providing a clinch-type LED lamp which can be easily connected to conducting wires of a standard type.

Furthermore, this LED lamp may be configured to allow effective thermal dissipation for correct operation of the LED.

Additionally, such an LED lamp should be able to be fabricated automatically with the aid of a method which is simple and inexpensive so as to address the economic constraints of fabricating motor vehicles.

A requirement also exists for a lighting device which uses conducting wires of a standard type and which is particularly suitable for the lights of a motor vehicle having complex geometries, thereby requiring that the lamps of one and same circuit be placed at very diverse spatial positions.

In one embodiment, a light emitting diode lamp, includes a pair of contacts for the electrical connection of the light emitting diode, in which the pair of contacts includes two crimp contacts separated electrically from one another, each crimp contact including a conducting input including a conducting crimping skirt and a clinching zone intended to receive by clinching an electrical contact of the light emitting diode.

Such a lamp may be easily crimpable to conducting wires of standard type and thus ensure simple and direct connection with the conducting wires. Crimping is used in place of welding so as to protect the conducting wires of the support and the electrical components of the LED from exposures to high temperatures which could damage or impair its performance.

It should be noted that the crimping skirts each make it possible to fix a conducting wire to power the LED, but also a pair of conducting wires so as to ensure a restoral of electrical conductivity in order to supply other LED lamps.

Each crimp contact may include a conducting output including a power supply tab coupled electrically to said conducting input.

By virtue of two additional conducting outputs, the LED lamps may easily be mounted in parallel so as to provide a flexible electrical circuit.

It may also be noted that the size of the power supply tabs may be adapted as a function of the quantity of heat that one wishes to dissipate according to the technical characteristics of the LEDs.

This light emitting diode lamp may be intended to be mounted on a support, and each crimp contact includes a means of fixing to the support intended to cooperate with a complementary means of fixing to the support provided on said support.

Each means of fixing to the support may include a plane face extending in a zone under the light emitting diode, the plane face being substantially perpendicular to the clinching zone and forming an obtuse angle with respect to the clinching zone, said plane face being situated opposite the clinching zone and situated at a distal end with respect to a central and vertical axis of the lamp.

This plane face makes it possible to fix the LED lamp in a suitable support, and also makes it possible to offer a heat exchange surface for improving the thermal dissipation of the LED.

Furthermore the arrangement of the plane face with respect to the main axis of the LED makes it possible to clear the clinching zone so as to leave a free passage for the instruments dedicated to the clinching, namely a punch and a die.

Advantageously, each plane face includes two bends which are substantially perpendicular to the clinching zone and which form two additional plane faces curved towards the interior of the lamp so as to form a housing in the zone under the light emitting diode and opposite the clinching zone.

These additional plane faces increase the heat exchange surface for the LED and their arrangement with respect to the LED also makes it possible to leave a passage free of any obstacle for the instruments dedicated to the clinching, because the plane face prolonged by two additional plane faces forms a housing so as to leave a free passage.

This light emitting diode lamp may further include a plastic retaining cap furnished with latching means adapted for cooperating with complementary latching means provided on said crimp contacts.

Such a cap ensures retention of the two crimp contacts side by side, but without contact between them, so as to avoid stressing the LED mechanically once the contacts have been crimped.

This retaining cap may include two retaining orifices for the conducting outputs, said retaining orifices being intended to be traversed respectively by one of said conducting outputs.

These orifices make it possible to electrically separate the conducting outputs from one another. These orifices also ensure guidance of the conducting wires intended to be connected to said conducting outputs. Furthermore, these orifices allow better thermal dissipation under the LED.

This retaining cap may also include two additional lateral orifices situated respectively opposite the clinching zones.

These additional lateral orifices make it possible to facilitate the thermal dissipation of the LED. Advantageously, the size of these lateral orifices may be adapted so as to leave a free passage for the instruments dedicated to the clinching since, by allowing a free passage to the clinching instruments, it is possible to mount the retaining cap on the crimp contacts before the LED is mounted by clinching to said contacts.

According to yet another characteristic of the light emitting diode lamp, the latter furthermore includes a pair of conducting wires, each conducting wire being crimped at its first end with the conducting input of the crimp contact of said lamp and being crimped at its second end with a conduction means able to cooperate with a power supply tab.

Such an LED lamp may be easily manufactured with the aid of an automatic cutting and crimping machine.

According to another aspect, there is proposed a lighting device, in particular for motor vehicle, including a support furnished with a plurality of niches intended to each receive a light emitting diode lamp and in which said light emitting diode lamps are linked together by conducting wires so that the conducting wires of a light emitting diode lamp are linked respectively with power supply tabs of a neighboring light emitting diode lamp.

According to another aspect, there is proposed a reel for automatic cutting and crimping machine including an edging strip, said edging strip being able to fix several light emitting diode lamps, each crimp contact being linked to the edging strip by said conducting input so that the crimp contact constitutes a prolongation of said edging strip.

Such a reel makes it possible to package the LED lamps by coiling with a view to being used by an automatic cutting and crimping machine. This reel therefore makes it possible to facilitate the automatic fabrication of the LED lamps. Furthermore this reel can be easily fabricated automatically with the aid of a follow-on tool.

According to another aspect, there is proposed a method of fabricating a light emitting diode lamp.

This method includes a step of fabricating a pair of crimp contacts and a step of clinching in which each electrical contact of said light emitting diode is clinched to one of said crimp contacts.

Advantageously, a crimp contact can be fabricated from a metal plate so that the various parts of which it is composed are obtained through successive bends so that the crimp contact forms just a single component.

According to one mode of implementation, a mounting step is performed, where a retaining cap is mounted on said pair of crimp contacts, said mounting step being performed after the clinching step.

According to another mode of implementation, the step of mounting the retaining cap is performed before the clinching step.

According to another aspect, there is proposed a method of fabricating a reel for automatic cutting and crimping machine comprising an edging strip, including:

fabricating, from a metal plate, a plurality of pairs of crimp contacts, each crimp contact including a conducting input and a clinching zone, and in which each crimp contact is linked to the edging strip by said conducting input so that the crimp contact constitutes a prolongation of the edging strip; and clinching each electrical contact of a light emitting diode to said clinching zone of one of said contacts of a pair of crimp contacts.

According to one mode of implementation, a mounting step is performed in which a retaining cap is mounted on each pair of crimp contacts, said mounting step being performed after the clinching step.

According to another mode of implementation, the step of mounting the retaining cap is performed before the clinching step.

BRIEF DESCRIPTION OF THE DRAWINGS

Other advantages and characteristics of the invention will become apparent on examining the detailed description of modes of implementation and embodiments, which are in no way limiting, and of the appended drawings in which.

Figure 1:
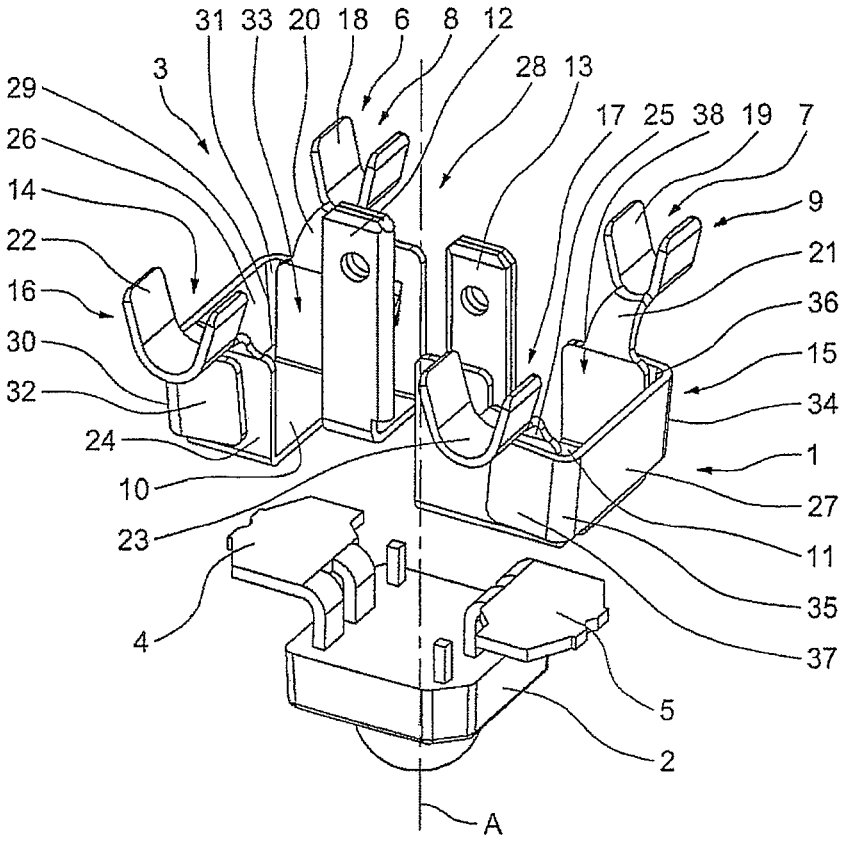
FIG. 1 schematically illustrates an embodiment of an LED lamp.

While the invention may be susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF THE PREFERRED EMBODIMENTS

Represented in FIG. 1 is a perspective view of an LED lamp 1. The LED lamp 1 comprises a clinch-type LED 2 and a pair of contacts 3. Also represented is a central and vertical axis A of the LED lamp 1.

The clinch-type LED 2 comprises two electrical contacts 4 and 5 which have a plane shape and which are intended to be clinched onto conducting surfaces suitable for clinching, that is to say the surfaces exhibit a sufficient thickness to be clinched to said electrical contacts 4 and 5.

The pair of contacts 3 comprises two crimp contacts 6 and 7 which make it possible to power the LED 2 electrically.

The crimp contacts 6 and 7 respectively comprise two conducting inputs 8 and 9, two clinching zones 10 and 11, two conducting outputs 12 and 13, two means of fixing 14 and 15 to a support, as well as two means for retaining the conducting wires 16 and 17. Said support will be described later in FIG. 6.

The conducting inputs 8 and 9 respectively comprise two conducting crimping skirts 18 and 19 intended to be crimped onto the conducting part of one or more conducting wires. The conducting inputs 8 and 9 are linked respectively to the clinching zones 10 and 11 by two intermediate input tabs 20 and 21.

The two clinching zones 10 and 11 are plane faces substantially perpendicular to the central and vertical axis A and have a surface suitable for the clinching of the electrical contacts of the LED 2.

The conducting outputs 12 and 13 are power supply tabs for other LED lamps so as to mount the latter in parallel. Indeed, the conducting outputs 12 and 13 are linked electrically to the clinching zones 10 and 11 respectively and thus allow the restoral of the electrical conductivity originating from the conducting inputs 8 and 9.

The retaining means for the conducting wires 16 and 17 respectively comprise two retaining crimping skirts 22 and 23 intended to be crimped onto an insulating part of the conducting wire or wires crimped respectively to the conducting inputs 8 and 9. The retaining means for the conducting wires 16 and 17 are linked respectively to the clinching zones 10 and 11 by two intermediate output tabs 24 and 25.

The means for fixing to the support 14 and 15 respectively comprise two plane faces 26 and 27. The two plane faces 26 and 27 are linked electrically to the clinching zones 10 and 11 respectively. These two plane faces 26 and 27 are substantially parallel to the central and vertical axis A and extend in a zone 28 under the LED 2 so that they form an obtuse angle with respectively the clinching zones 10 and 11.

The plane face 26 comprises two bends 29 and 30 which are substantially perpendicular to the clinching zone 10. These two bends 29 and 30 are situated at the respective ends of the plane face 26 and make it possible to form two additional plane faces 31 and 32 from said plane face 26. By virtue of the first bend 29 it is possible to curve the first additional plane face 31 towards the interior of the lamp, that is to say in the direction of the central and vertical axis A of the lamp, so that this additional plane face 31 lies behind and against the intermediate input tab 20. By virtue of the second bend 30 it is possible to curve the second additional plane face 32 towards the interior of the lamp so that this second additional plane face 32 lies in front of and against the intermediate output tab 24.

The plane face 26 and the two additional plane faces 31 and 32 are substantially perpendicular to the clinching zone 10 and are situated at the ends of the latter so as to form a housing 33 situated in the zone 28 under the LED and opposite said clinching zone 10.

The plane face 27 comprises two bends 34 and 35 which are substantially perpendicular to the clinching zone 11. These two bends 34 and 35 are situated at the respective ends of the plane face 27 and make it possible to form two additional plane faces 36 and 37 from said plane face 27. By virtue of the third bend 34 it is possible to curve the third additional plane face 36 towards the interior of the lamp so that this additional plane face 36 lies behind and against the intermediate input tab 21. By virtue of the fourth bend 35 it is possible to curve the fourth additional plane face 37 towards the interior of the lamp so that this fourth additional plane face 37 lies in front of against the intermediate output tab 25.

The plane face 27 and the two additional plane faces 36 and 37 are substantially perpendicular to the clinching zone 11 and are situated at the ends of the latter so as to form a housing 38 situated in the zone 28 under the LED and opposite said clinching zone 11.

Figure 2:
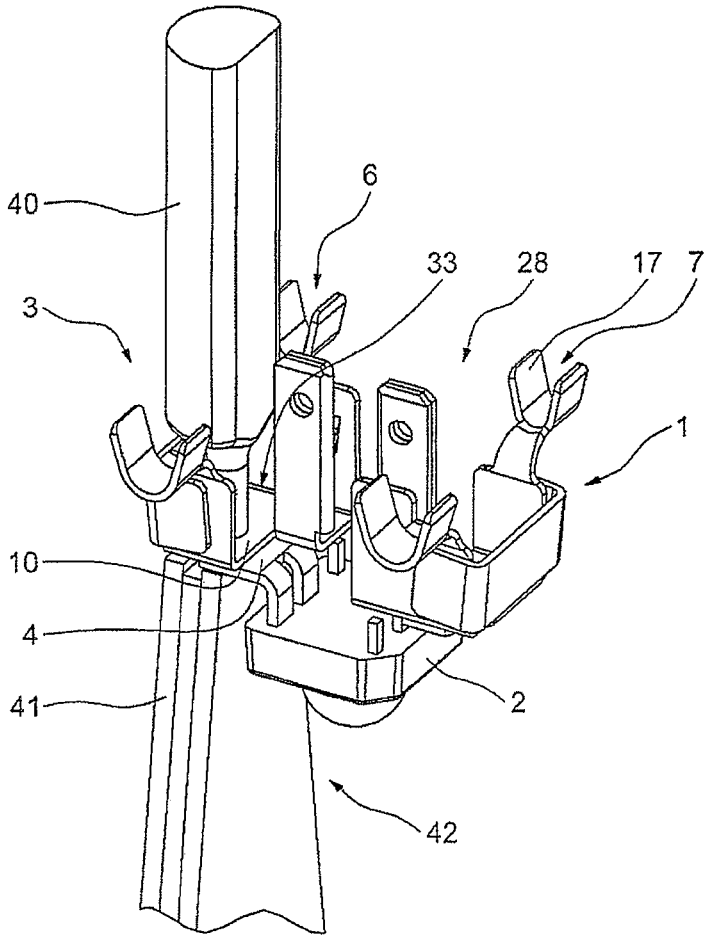
FIG. 2 schematically illustrates a process for clinching an LED onto a pair of contacts.

Represented in FIG. 2 is a perspective view of a mode of clinching of an LED 2 onto a crimp contact 6 of a pair of contacts 3 of an LED lamp 1 such as described in FIG. 1. Certain references described in the previous figure have been carried over to FIG. 2.

The crimp contacts 6 and 7 are made of a conducting metal, for example copper, and the various elements of which they consist participate in the thermal dissipation of the LED. The various elements which constitute each crimp contact are: the two conducting inputs 8 and 9, the two clinching zones 10 and 11, the two conducting outputs 12 and 13, the two means for fixing 14 and 15 to a support, as well as the two retaining means for the conducting wires 16 and 17.

The LED lamp just described makes it possible to provide a crimp-type LED lamp.

Also represented in FIG. 2 are two clinching instruments, namely a punch 40 and a die 41. In FIG. 2, the punch 40 is placed in the zone 28 under the LED 2 and the die 41 is placed in a zone 42 on the LED 2.

To clinch the LED 2 onto the crimp contact 6, the electrical contact 4 of the LED 2 is placed on the clinching zone 10 of the crimp contact 6, then said punch 40 is placed in the housing 33 and the die 41 is placed on said electrical contact 4, so that the electrical contact 4 of the LED 2 and the crimp contact 6 are placed between the punch 40 and the die 41.

Figure 3:
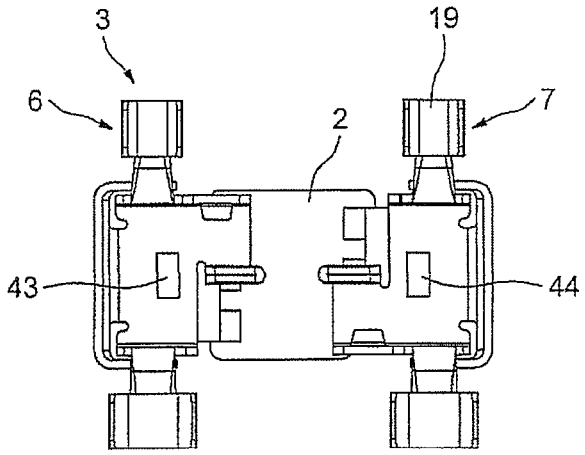
FIG. 3 illustrates a schematic view of an LED clinched onto a pair of contacts.

Represented in FIG. 3 is a schematic view of an LED 2 clinched onto a pair of contacts 3. This view is a view from below with respect to the LED 2. Certain references described in the previous figures have also been carried over to this FIG. 3. Represented are two clinched zones 43 and 44 which are, respectively, the result of the clinching of the electrical contact 4 with the crimp contact 6 and the result of the clinching of the electrical contact 5 with the crimp contact 7.

Figure 4:
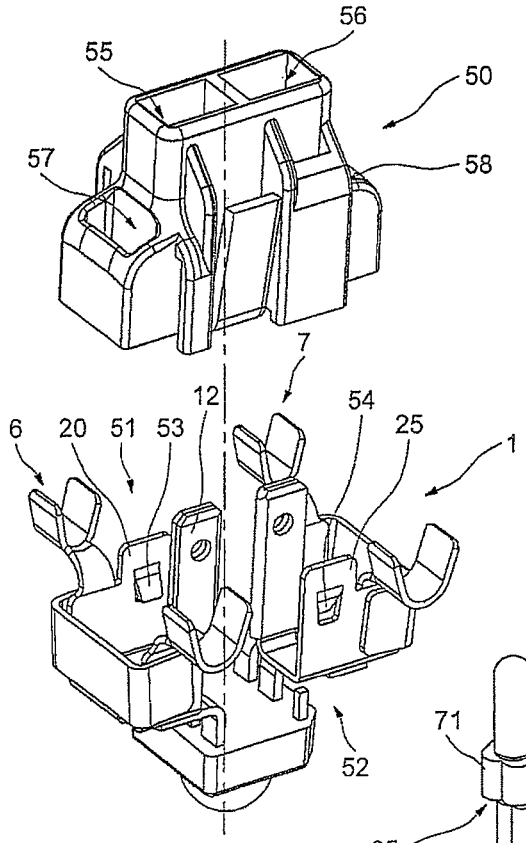
FIG. 4 illustrates the mounting of a retaining cap on an LED lamp.

Represented in FIG. 4 is a perspective view of a mode of mounting a retaining cap 50 on an LED lamp 1 such as described in the previous figure. Certain references described in the previous figures have also been carried over to this FIG. 4.

The retaining cap 50 is made of plastic so as to prevent electrical contact between the crimp contacts 6 and 7, when the retaining cap is mounted on said crimp contacts 6 and 7.

This retaining cap 50 is furnished with latching means, not represented in the figure, adapted for cooperating with complementary latching means, respectively 51 and 52, provided on said crimp contacts 6 and 7.

The latching means 51 and 52 may comprise, for example, "clips" respectively 53 and 54. These "clips" 53 and 54 are latching tabs emanating respectively from the intermediate input tab 20 and from the intermediate output tab 25. These latching tabs 53 and 54 are bent towards the interior of the LED lamp 1 and are able to clip the retaining cap 50 by cooperating with the latching means of said cap 50.

The retaining cap 50 also comprises two retaining orifices 55 and 56 for the conducting outputs 12 and 13 respectively, as well as additional lateral orifices 57 and 58.

Figure 5:
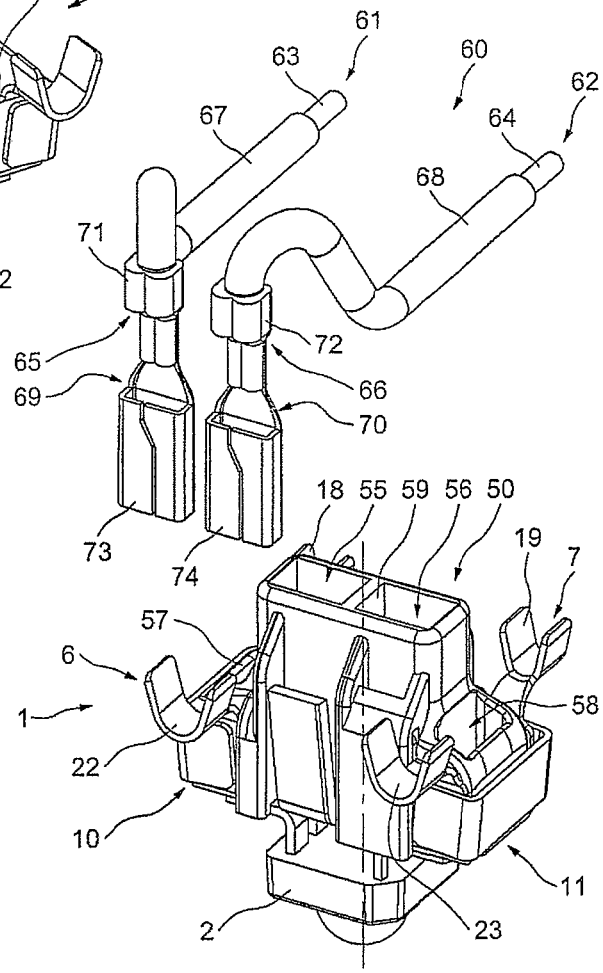
FIG. 5 illustrates a schematic view of a retaining cap mounted on an LED lamp.

Represented in FIG. 5 is a retaining cap 50 mounted on the LED lamp 1. Certain references described in the previous figures have also been carried over to this FIG. 5.

When the retaining cap 50 is mounted on the LED lamp 1, it improves the retention of the two crimp contacts 6 and 7 side by side and thus avoids stressing the LED 2 mechanically.

This retaining cap 50 also strengthens the cohesion between the crimp contacts 6 and 7 and the LED 2 when a pair of conducting wires 60 are crimped onto said crimp contacts 6 and 7.

Conducting wires 61 and 62 are intended to power the LED lamp 1. These conducting wires 61 and 62 respectively comprise two first ends 63 and 64, two second ends 65 and 66, two intermediate parts 67 and 68, as well as two conduction means 69 and 70.

The conduction means 69 and 70 respectively comprise two conducting crimping skirts 71 and 72, and two contacts for tab 73 and 74 which are each able to cooperate with a power supply tab.

The ends 63 to 66 are conducting stripped parts.

The first ends 63 and 64 are crimped respectively to the conducting crimping skirts 18 and 19 of the crimp contacts 6 and 7.

The two ends 65 and 66 are crimped respectively to the two conducting crimping skirts 71 and 72 of the conduction means 69 and 70.

The two intermediate parts 67 and 68 are insulating non-stripped parts and are crimped respectively to the retaining crimping skirts 22 and 23 of said crimp contacts 6 and 7. The retaining crimping skirts 22 and 23 each make it possible to immobilize the conducting wires 61 and 62 so as to preclude possible breakages of copper strands of said conducting wires at the level of their first stripped ends 63 and 64.

The additional lateral orifices 57 and 58 make it possible to promote the thermal dissipation of the LED 2.

Moreover these additional lateral orifices 57 and 58 are situated respectively opposite the clinching zones 10 and 11. Furthermore these orifices 57 and 58 may be adapted so as to leave a passage for the clinching punch 40 so as to clinch the LED 2 onto the crimp contacts 6 and 7 once the retaining cap 50 has been mounted on said crimp contacts 6 and 7.

Furthermore, the two retaining orifices 55 and 56 are traversed respectively by the conducting outputs 12 and 13 and make it possible to separate the conducting outputs 12 and 13, so as to prevent them from coming into contact the one 12 with the other 13. This electrical separation is achieved with the aid of a separation 59 placed between the two retaining orifices 55 and 56.

Additionally, when it is desired to mount several LED lamps in parallel, the pair 60 of conducting wires which are crimped to an LED lamp are linked with the power supply tabs 12 and 13 of another neighboring LED lamp.

The retaining orifices 55 and 56 also make it possible to guide the conducting wires 60 and 61 so as to connect them respectively to the conducting outputs 12 and 13.

Figure 6:
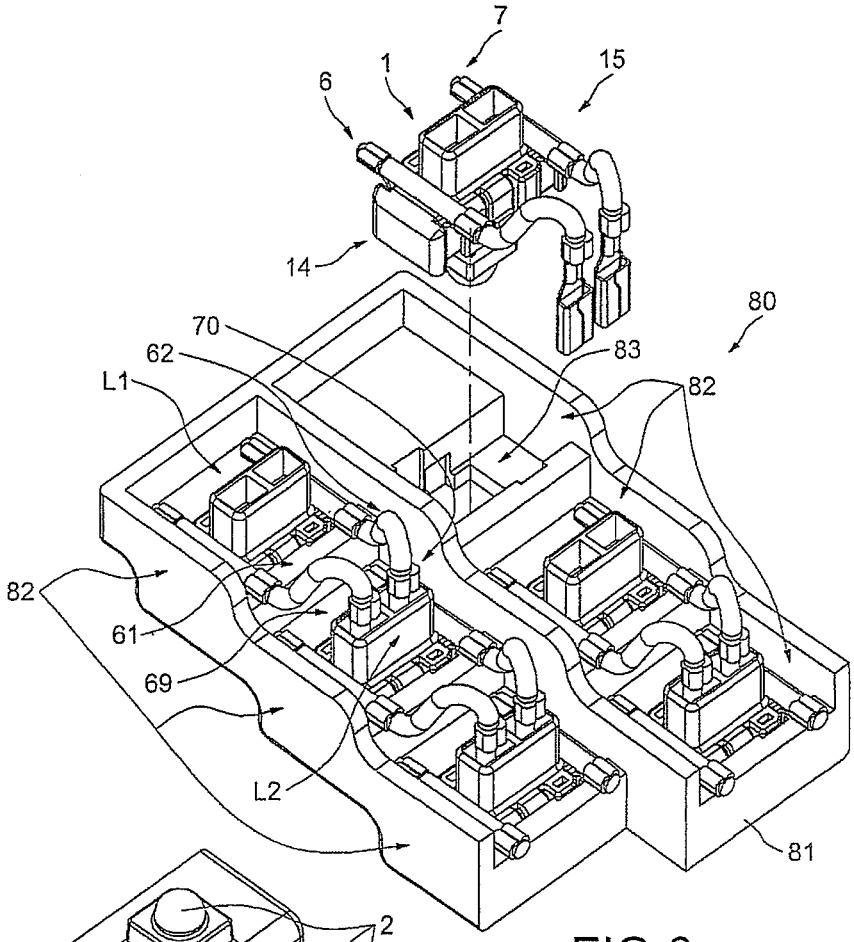
FIG. 6 illustrates a lighting device comprising a plurality of LED lamps.

Represented in FIG. 6 is a lighting device 80 comprising a plurality of LED lamps 1. Certain references described in the previous figures have also been carried over to this FIG. 6.

The lighting device 80 comprises a support 81 which is furnished with a plurality of niches 82. Each niche 82 is intended to receive an LED lamp 1 and each niche 82 comprises complementary means for fixing to the support 83. These complementary means for fixing to the support 83 cooperate with the means for fixing to the support 14 and 15 of said LED lamp 1.

In this lighting device 80, a plurality of LED lamps are mounted in parallel so that the conducting wires 61 and 62 of an LED lamp L1 are linked by their conduction means 69 and 70 with respectively the power supply tabs of a neighboring LED lamp L2.

The great flexibility of curvature of the conducting wires which link the LED lamps together makes it possible for several LED lamps to be easily mounted in parallel. This mounting makes it possible to position the LED lamps at different spatial positions, it is therefore well suited to a support having a complex geometry.

Figure 7:
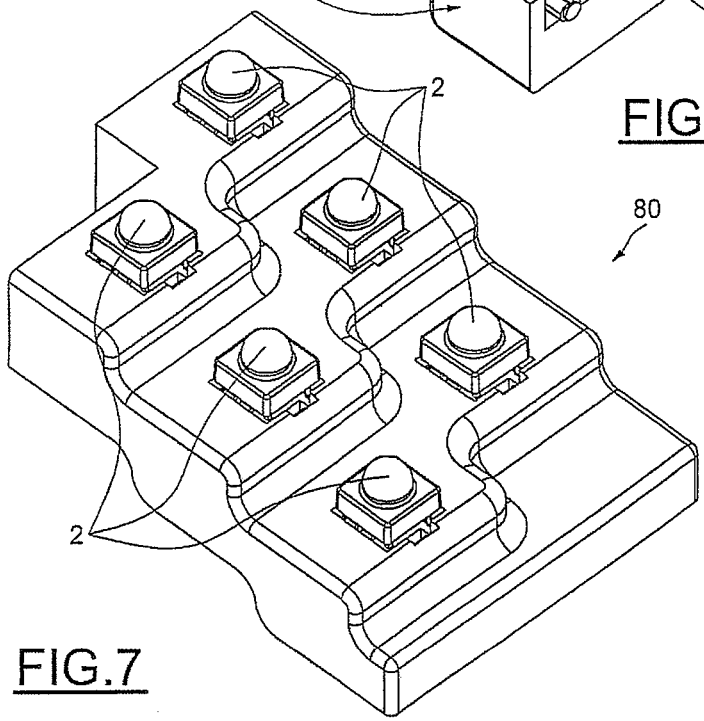
FIG. 7 is a view from above of the lighting device described in FIG. 6.

Represented in FIG. 7 is another view of the lighting device 80. This view is a view from above, the varied positions of the LEDs 2 may be noted.

Figure 8:
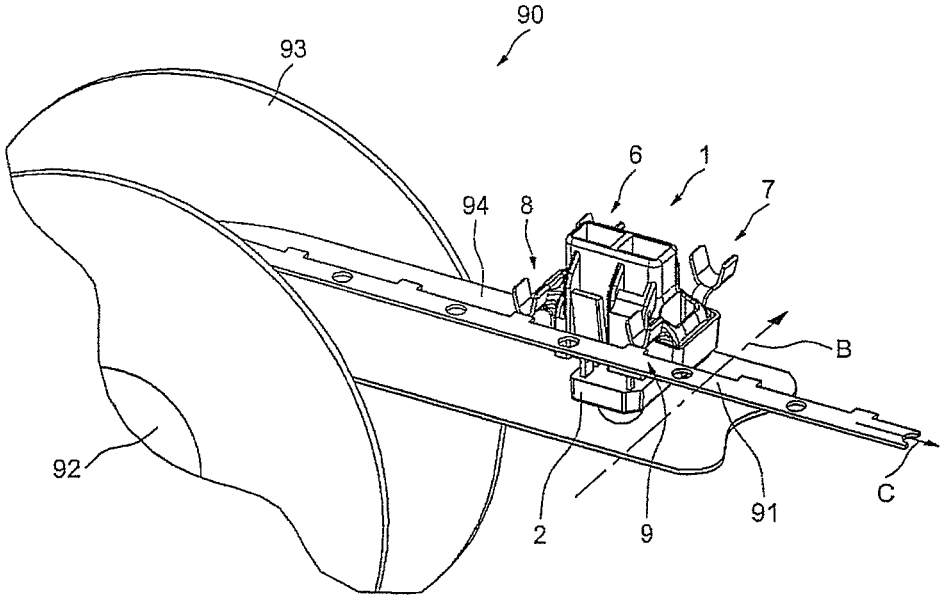
FIG. 8 illustrates a reel for automatic cutting and crimping machine.

Represented in FIG. 8 is a reel 90 for automatic cutting and crimping machine. Certain references described in the previous figures have also been carried over to this FIG. 8.

The reel 90 comprises an edging strip 91 which is able to fix several LED lamps 1. The LED lamps 1 are fixed to the edging strip 91 by way of respective conducting inputs 8 and 9 of the crimp contacts 6 and 7, so that the crimp contacts 6 and 7 constitute a prolongation of said edging strip 91.

The expression prolongation of the edging strip 91 is understood to mean that the crimp contacts 6 and 7 form just a single metal component with the edging strip 91 of the reel 90. Indeed, the crimp contacts 6 and 7 extend in the direction of an axis B which is perpendicular to the main axis C of the edging strip.

The reel 91 has the property of being able to coil up. Furthermore, the reel 91 can coil up on a coiling axis 92 of a support cylinder 93. Furthermore, the support cylinder 93 can comprise a flexible protective plate 94 placed on the LEDs 2 and intended to protect the LED lamps 1 when the reel 90 is coiled into the support cylinder 93. This flexible plate 94 can be made of synthetic foam so as to absorb the knocks during the movement of said cylinder 93.

Figure 9:
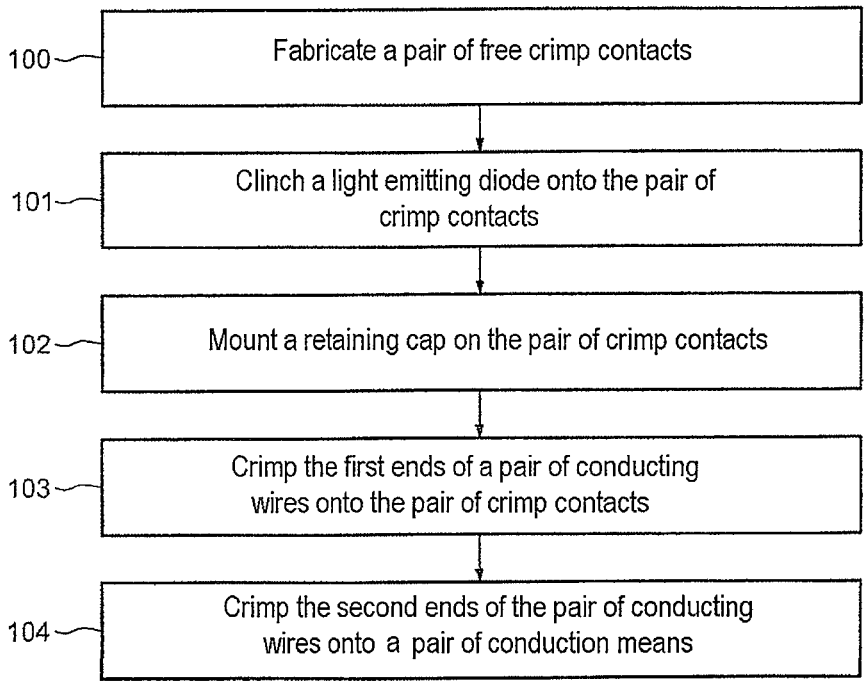
FIG. 9 illustrates a mode of manual fabrication of an LED lamp.

Represented in FIG. 9 are the main steps of a mode of manual fabrication of an LED lamp.

This method of fabricating an LED lamp comprises a first step of fabricating a pair of free crimp contacts 100. In this step 100 the pair of contacts is fabricated from a metal plate which is made to undergo successive bends so as to obtain the various constituent elements of each crimp contact.

Next, a second clinching step 101 is performed in which an LED 2 is clinched onto the pair of crimp contacts.

Thereafter a third mounting step 102 is performed in which a retaining cap 50 is mounted on the pair of crimp contacts. As a variant it will be possible to perform the mounting step 102 before the clinching step 101.

Furthermore, a fourth crimping step 103 is performed in which the first stripped ends 63 and 64 of the conducting wires 61 and 62 are crimped respectively onto conducting crimping skirts 18 and 19 of the crimp contacts.

In a fifth crimping step 104, the second stripped ends 65 and 66 of the conducting wires 61 and 62 are crimped respectively onto conducting crimping skirts 71 and 72 of two conduction means 69 and 70.

This fabrication method may also be implemented automatically.

Figure 10:
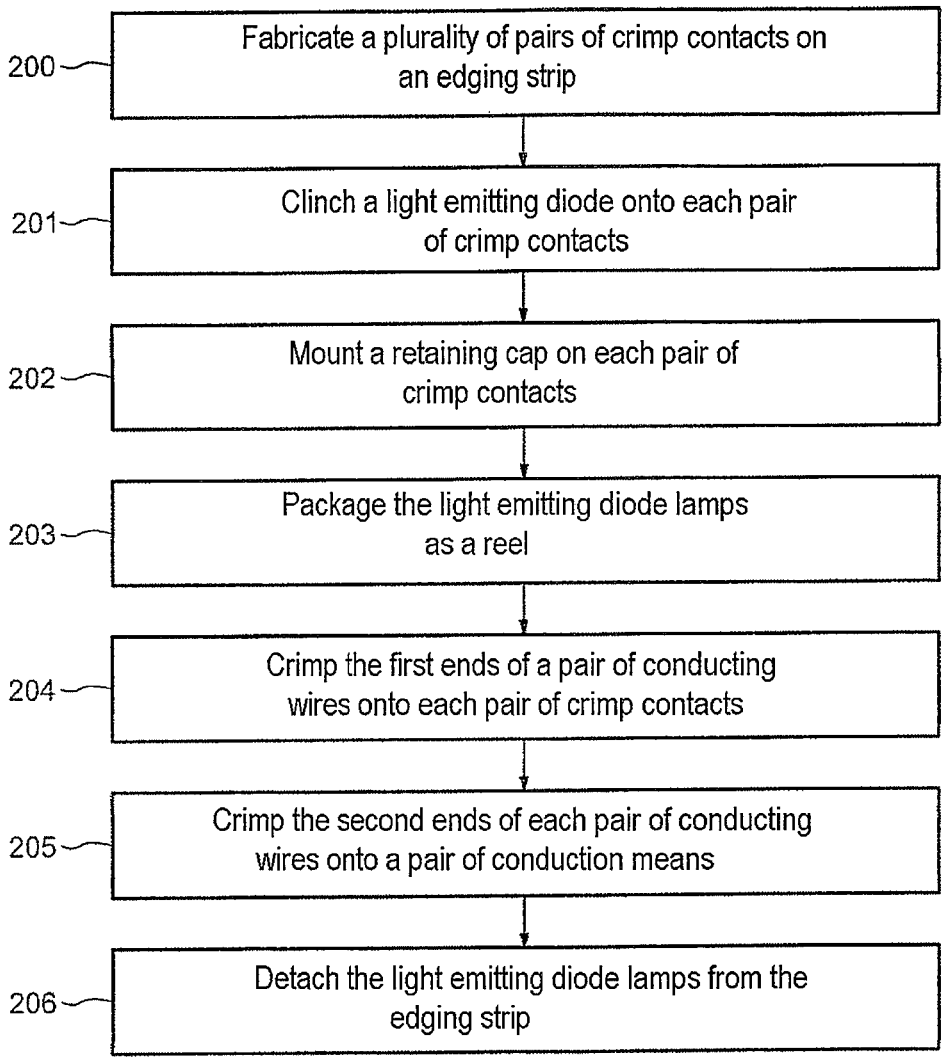
FIG. 10 illustrates a mode of automatic fabrication of an LED lamp on the basis of a reel for automatic cutting and crimping machine.

Represented in FIG. 10 are the main steps of a method of automatic fabrication of an LED lamp on the basis of a reel for automatic cutting and crimping machine.

The method of automatically fabricating an LED lamp comprises a first step of fabricating a plurality of pairs of crimp contacts on an edging strip 200. In this step 200 said pairs of crimp contacts are fabricated from a metal plate which is made to undergo successive bends to obtain an edging strip 91 prolonged by the pairs of crimp contacts. The various constituent elements of each crimp contact are obtained by virtue of the successive bends, the crimp contacts being fixed to the edging strip.

Next, a second clinching step 201 is performed in which an LED 2 is clinched onto each pair of crimp contacts.

Thereafter, a third mounting step 202 is performed in which a retaining cap 50 is mounted on each pair of crimp contacts. As a variant it will be possible to perform the mounting step 202 before the clinching step 201.

Steps 200 to 202 make it possible to fabricate a reel for automatic cutting and crimping machine. These steps 200 to 202 may be implemented with the aid of a follow-on tool.

Furthermore, a fourth step of packaging the LED lamps as a reel 203 is performed in which the edging strip furnished with the LED lamps is coiled up into a reel support cylinder. During this packaging step, a flexible protective plate 94 can also be inserted, between a coiling axis 92 of the support cylinder 93 and the reel 90, so as to prevent any knocks on the LED lamps.

Next, a fifth crimping step 204 is performed in which the first stripped ends 63 and 64 of the conducting wires 61 and 62 are crimped respectively onto the conducting crimping skirts 18 and 19 of the crimp contacts.

In a sixth crimping step 205, the second stripped ends 65 and 66 of the conducting wires 61 and 62 are crimped respectively onto conducting crimping skirts 71 and 72 of conduction means 69 and 70.

In a seventh cutting step 206, each LED lamp is detached from the edging strip by a cutting operation.

Steps 204 to 206 may be implemented with the aid of an automatic cutting and crimping machine.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. Light emitting diode lamp, comprising:

a light emitting diode with at least two electrical contacts, each contact having a sheet shaped end, and a pair of crimp contact parts for the electrical connection of the light emitting diode, wherein the pair of crimp contact parts are separated electrically from one another, each crimp contact part comprising:

at least a conductive input element, the conductive input element comprising:

a conductive crimping skirt and a planar clinching zone with free access on both sides of the plane so as to enable the planar clinching zone to be assembled by clinching between a punch and a die, to the sheet shaped end of an electrical contact of the light emitting diode, the crimping skirt being linked to a first side of the planar clinching zone by an intermediate tab, the intermediate tab comprising a first portion linked to the planar clinching zone and perpendicular to the planar clinching zone; and at least a conductive output element, the conductive output element comprising:

a power supply tab connected electrically to said conductive input element, but placed at a distance from the crimping skirt of the input element, the power supply tab being so designed as to be able to be inserted into, or around, a corresponding conduction means ending a conducting wire, at least a boxing portion comprising a lateral planar face extending from a second side of the clinching zone, perpendicularly or at an obtuse angle from the clinching zone, in the same direction as the first portion of the intermediate tab supporting the crimping skirt, the second side being adjacent to the first side of the clinching zone, wherein the clinching zone, the crimping skirt, the intermediate tab, the power supply tab, and the boxing portion are one single-piece made of same material.

2. Light emitting diode lamp according to claim 1, wherein the light emitting diode comprises two contacts clinched each to one crimp contact part, so that the clinching zones of the crimp contact parts are in a same plane and form a support zone configured to lean against a mounting support part, the two clinching zones being prolonged with two lateral planar faces extending on two opposite sides of the lamp, away from the diode.

3. Light emitting diode lamp according to claim 1, comprising a light emitting diode with two contacts clinched each to one crimp contact part, so that the clinching zones of the crimp contact parts are in a same plane and form a support zone configured to lean against a mounting support part, the two clinching zones being prolonged with two lateral planar faces extending on two opposite sides of the lamp, away from the diode.

4. Light emitting diode lamp according to claim 2, in which each lateral planar face is prolonged by one front and one back planar portion bent substantially perpendicular to the planar face towards the clinching zone, so that at least one of the front or back planar portion is in a plane close to, or in contact with, a plane containing the intermediate tab, and so that the two clinching zones, the two lateral faces, the two front planar portions and the two back planar portions form a box contour portion enclosing at least a portion of the intermediate tab configured to be inserted in a box contour of the mounting support part.

5. Light emitting diode lamp according to claim 3, in which each lateral planar face is prolonged by one front and one back planar portion bent substantially perpendicular to the planar face towards the clinching zone, so that at least one of the front or back planar portion is in a plane close to, or in contact with, a plane containing the intermediate tab, and so that the two clinching zones, the two lateral faces, the two front planar portions and the two back planar portions form a box contour portion enclosing at least a portion of the intermediate tab and configured to be inserted in a box contour of the mounting support part.

6. Light emitting diode lamp according to claim 5, further comprising a plastic retaining cap furnished with latching means configured to cooperate with at least a complementary latching means provided on each of said crimp contact parts, said plastic retaining cap being configured to be at least partly inserted within the box contour portion defined by the crimp contact parts.

7. Light emitting diode lamp according to claim 6, in which the retaining cap comprises two separate retaining orifices for the power supply tabs of the conductive outputs, each of said retaining orifices being intended to be traversed by one of said conduction means ending a conducting wire.

8. Light emitting diode lamp according to claim 7, in which the retaining cap comprises two additional lateral orifices each situated opposite a clinching zone.

9. Lighting device, in particular for a motor vehicle, comprising a support furnished with a plurality of niches intended to each receive a light emitting diode lamp as described in claim 1, and in which said light emitting diode lamps are linked together by portions of conductive wires, each portion of conductive wire linking a crimping skirt of a crimp contact part of one light emitting diode to a power supply tab of a crimp contact part of a neighboring light emitting diode lamp.

10. Lighting device, in particular for motor vehicle, comprising a support furnished with a plurality of niches intended to each receive a light emitting diode lamp as described in claim 7 and in which said light emitting diode lamps are linked together by portions of conductive wires, each portion of conductive wire linking a crimping skirt of a crimp contact part of one light emitting diode, to a conduction means inserted onto a power supply tab of a neighbouring light emitting diode lamp, the conduction means being inserted into the orifices of the retaining cap surrounding the power supply tabs.

11. Reel for an automatic cutting and crimping machine comprising an edging strip, wherein said edging strip is a single piece with several pairs of crimp contact parts as described in claim 1, each crimp contact part being linked to the edging strip by an end of one of its conductive input elements.

12. Reel for an automatic cutting and crimping machine comprising an edging strip, wherein said edging strip is a single piece with several pairs of crimp contact parts each pertaining to a light emitting diode lamp as described in claim 6, each crimp contact part being linked to the edging strip an end of one of its conductive input elements.

13. Method of fabricating a light emitting diode lamp, comprising fabricating a pair of crimp contact parts as described in claim 1, linked to a same edging strip, and clinching two electrical contacts of a light emitting diode, each to one of said crimp contact parts, the crimp contact parts being still attached to the edging strip.

14. Method of fabricating a light emitting diode lamp according to claim 13, further comprising mounting a retaining cap on said pair of crimp contact parts, said mounting being performed after clinching each electrical contact of said light emitting diode.

15. Method of fabricating a light emitting diode lamp according to claim 13, further comprising mounting a retaining cap on said pair of crimp contact parts, said mounting being performed before clinching each electrical contact of said light emitting diode.

16. Light emitting diode lamp according to claim 6, in which the conductive crimping skirts are each linked to a clinching zone by an intermediate tab, and in which the plastic retaining cap is configured to be inserted between the intermediate output tabs so as to be surrounded by the intermediate output tabs.

17. Light emitting diode lamp according to claim 1, in which the power supply tab extends from the clinching zone, perpendicularly to the clinching zone, and in the same direction as the first portion of the intermediate tab extends from the clinching zone.

18. Reel for an automatic cutting and crimping machine comprising an edging strip, wherein said edging strip is single-piece with at least two crimp contact parts as described in claim 1, and wherein the planar clinching zones are at a distance from one another, which makes it possible to assemble each clinching zone, to an electrical contact of a light emitting diode, without separating the crimp contact parts from the reel.

19. Light emitting diode lamp according to claim 1, wherein the one single-piece comprising the clinching zone, the crimping skirt, the intermediate tab, the power supply tab, and the boxing portion is in a shape which can be obtained by cutting and folding a sheet of metal.

* * * * *